US010502217B2

(12) United States Patent
Andrews et al.

(10) Patent No.: US 10,502,217 B2
(45) Date of Patent: Dec. 10, 2019

(54) INTEGRALLY GEARED COMPRESSOR HAVING A COMBINATION OF CENTRIFUGAL AND POSITIVE DISPLACEMENT COMPRESSION STAGES

(71) Applicant: ATLAS COPCO COMPTEC, LLC, Voorheesville, NY (US)

(72) Inventors: Michael Andrews, Schenectady, NY (US); Todd Steven Abbot Gibbs, Amsterdam (NL)

(73) Assignee: ATLAS COPCO COMPTEC, LLC, Voorheesville, NY (US)

( * ) Notice: Subject to any disclaimer, the term of this patent is extended or adjusted under 35 U.S.C. 154(b) by 193 days.

(21) Appl. No.: 15/484,552

(22) Filed: Apr. 11, 2017

(65) Prior Publication Data

US 2017/0292525 A1 Oct. 12, 2017

Related U.S. Application Data

(60) Provisional application No. 62/321,016, filed on Apr. 11, 2016.

(51) Int. Cl.

| | |
|---|---|
| ***F04D 25/16*** | (2006.01) |
| ***F04D 17/12*** | (2006.01) |
| ***F04B 23/08*** | (2006.01) |
| ***F04B 23/14*** | (2006.01) |
| ***F04D 19/04*** | (2006.01) |
| ***F04C 29/00*** | (2006.01) |

(Continued)

(52) U.S. Cl.

CPC ..... *F04D 25/163* (2013.01); *F04B 23/08* (2013.01); *F04B 23/14* (2013.01); *F04C 18/16* (2013.01); *F04C 23/005* (2013.01); *F04C 29/005* (2013.01); *F04D 17/12* (2013.01); *F04D 19/046* (2013.01)

(58) Field of Classification Search

CPC ..... F04D 19/046; F04D 25/163; F04D 17/12; F04B 23/08; F04B 23/14

See application file for complete search history.

(56) References Cited

U.S. PATENT DOCUMENTS 2,548,609 A * 4/1951 Johan ..... F02B 33/00 417/203
3,001,692 A * 9/1961 Schierl ..... F04D 25/163 415/122.1
3,026,929 A 3/1962 Burns (Continued)

FOREIGN PATENT DOCUMENTS

CN 103967811 A 8/2014

OTHER PUBLICATIONS

International Search Report and Written Opinion for PCT Application No. PCT/US2017/026900, dated Jun. 19, 2017.

(Continued)

*Primary Examiner* — Peter J Bertheaud

(74) *Attorney, Agent, or Firm* — Schmeiser, Olsen & Watts, LLP

(57) ABSTRACT

A compressor including a gear system configured to be driven by a drive unit, a plurality of compression stages coupled to the gear system, wherein the plurality of compression stages includes at least one centrifugal compression stage and at least one positive displacement compression stage, is provided. Furthermore, an associated method is also provided.

20 Claims, 18 Drawing Sheets

(51) Int. Cl.
*F04C 23/00* (2006.01)
*F04C 18/16* (2006.01)

(56) References Cited

U.S. PATENT DOCUMENTS

| | | | | |
|---|---|---|---|---|
| 3,238,713 | A | 3/1966 | Wallace | |
| 3,476,485 | A | 11/1969 | Kunderman | |
| 3,640,646 | A | 2/1972 | Hornschuch et al. | |
| 4,010,016 | A | 3/1977 | Haugen | |
| 4,086,019 | A | 4/1978 | Poole | |
| 4,219,306 | A | 8/1980 | Fujino et al. | |
| 5,154,571 | A * | 10/1992 | Prumper | F04D 25/02 415/124.1 |
| 5,485,719 | A | 1/1996 | Wulf | |
| 6,488,467 | B2 * | 12/2002 | Czechowski | F04D 25/163 415/122.1 |
| 7,107,973 | B1 | 9/2006 | Jones et al. | |
| 7,559,200 | B2 | 7/2009 | Rodehau et al. | |
| 8,393,856 | B2 * | 3/2013 | Small | F04D 17/12 415/122.1 |
| 8,980,195 | B2 * | 3/2015 | Pelton | C10J 3/485 422/214 |
| 2013/0041195 | A1 | 2/2013 | Pelton | |
| 2013/0058761 | A1 | 3/2013 | Nass et al. | |
| 2014/0161588 | A1 | 6/2014 | Miyata et al. | |

OTHER PUBLICATIONS

English translation of Chinese Office Action for application No. 201710232749.2 dated Jul. 29, 2019.

* cited by examiner

INTEGRALLY GEARED COMPRESSOR HAVING A COMBINATION OF CENTRIFUGAL AND POSITIVE DISPLACEMENT COMPRESSION STAGES

This application claims priority to and the benefit of U.S. Provisional Application No. 62/321,016, filed Apr. 11, 2016, entitled, "Integrally Geared Compressor Having a Combination of Centrifugal and Positive Displacement Compression Stages."

FIELD OF TECHNOLOGY

The following relates to an integrally geared compressor, and more specifically to an integrally geared compressor having a centrifugal compressor stage and a positive displacement compressor stage.

BACKGROUND

Various types of compressors exist, each having advantages and disadvantages under operating conditions. For instance, centrifugal compressors efficiently and reliably manage large volumes of cold gas, while positive displacement compressors can be used to manage high pressure ratios and small volumes of gas. For instance, as liquefied natural gas (LNG) systems have developed, higher pressures are required to supply gas to the main drivers. While the supply side of the system is cryogenic and low pressure, the delivery side is non-cryogenic, higher pressure ratios, and small volumes.

Thus, a need exists for an integrally geared compressor utilizing a combination centrifugal compressor and positive displacement compressor.

SUMMARY

A first aspect relates generally to an integrally geared compressor having a centrifugal compressor stage and a positive displacement compressor stage.

A second aspect relates generally to a compressor including a gear system configured to be driven by a drive unit, a plurality of compression stages coupled to the gear system, wherein the plurality of compression stages includes at least one centrifugal compression stage and at least one positive displacement compression stage.

A third aspect relates generally to an integrally geared compressor having a housing, comprising a drive gear, the drive gear including a drive shaft coupled to a drive unit, a first pinion meshed with the drive gear on a first side of the drive gear, the first pinion including a first pinion shaft, a second pinion meshed with the drive gear on a second side of the drive gear, the second pinion including a second pinion shaft, a third pinion meshed with the drive gear on a different plane than the first pinion and the second pinion, the third pinion include a third pinion shaft, a positive displacement compression stage coupled to: (i) the first pinion shaft, or (ii) the drive shaft. and a centrifugal compression stage coupled to second pinion shaft A fourth aspect relates generally to a method comprising combining at least one centrifugal compression stage and at least one positive displacement compression stage in a housing of an integrally geared compressor.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
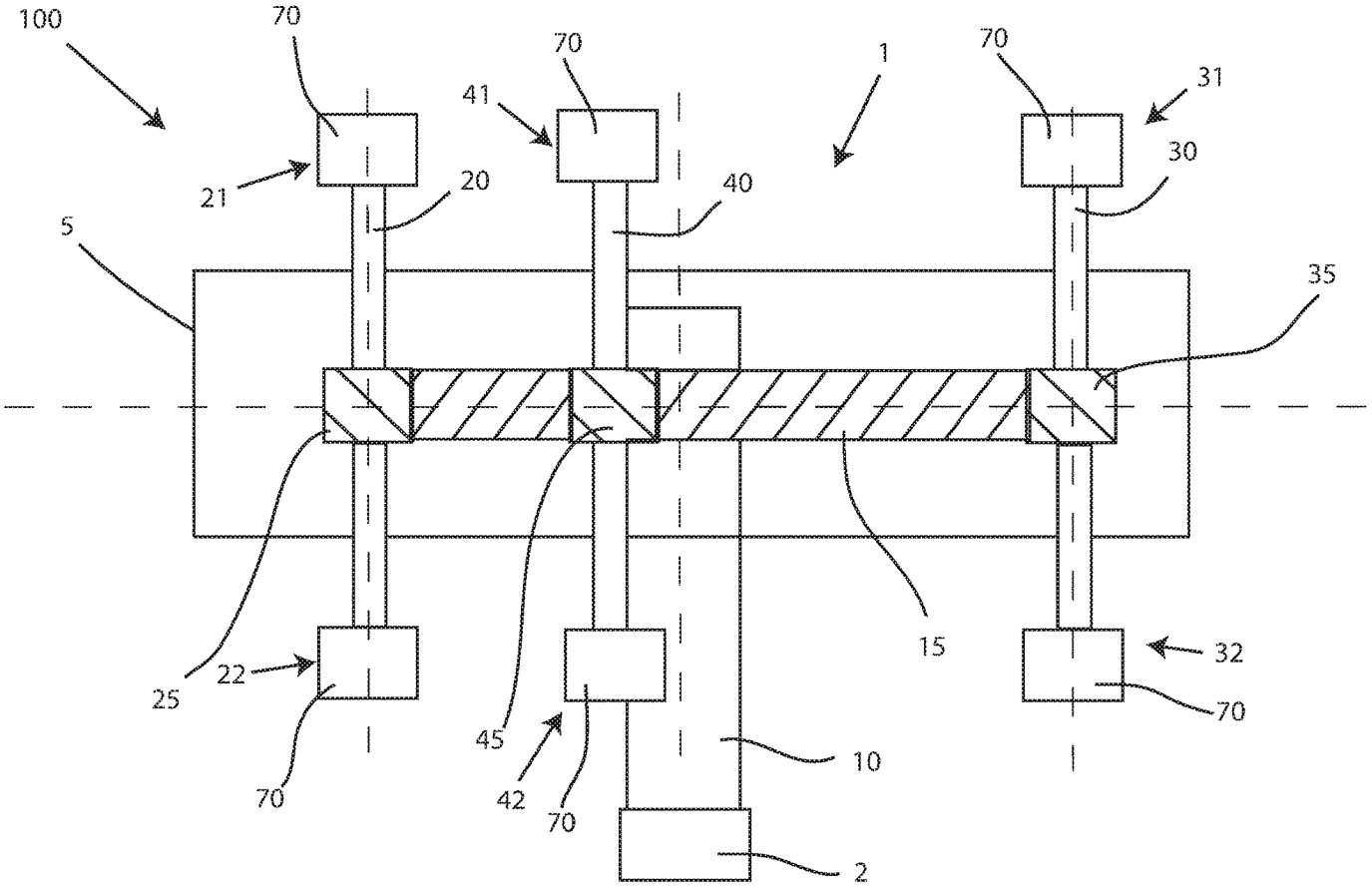
FIG. 1 depicts top view of a schematic illustration of a first embodiment of a compressor.

Referring to the drawings, FIG. 1 depicts embodiments of a compressor 100. Embodiments of the compressor 100 may be an integrally geared compressor. Compressor 100 may be used for various gas compression application, such as LNG applications for LNG powered vessels, energy recovery and gas process control in gas compression applications. Embodiments of compressor 100 may include a combination of one or more centrifugal compressor stages and one or more positive displacement compressor stages, such as a rotary screw stage. These integrated compressor stages may be arranged in a single gearbox 5. System requirements may determine a configuration of the compressor 100 and/or a number of compression stages. For example, embodiments of compressor 100 may be a multi-stage compressor, wherein system requirements may dictate a number of centrifugal compression stages, along with a number of section or type of positive displacement compression.

Moreover, compressor 100 may include a gear system 1. Embodiments of the gear system 1 may be integrated into or arranged in a single gearbox 5. The gearbox 5 may be a gearbox or housing that houses, receives, supports, accommodates, etc., the components of the gear system 1 of the compressor 100. Embodiments of the gear system 1 of the compressor 100 may include a drive shaft 10, a drive gear 15, a first pinion shaft 20, a first pinion gear 25, a second pinion shaft 30, a second pinion gear 35, a third pinion shaft 40, and a third pinion gear 45.

Embodiments of the gear system 1 of the compressor 100 may include a drive shaft 10 and a drive gear 15. The drive gear 15 may be operably mounted to the drive shaft 10. For instance, the drive gear 15 may be fastened to the drive shaft 10, wherein rotation of the drive shaft 10 translates to rotation of the drive gear 15. In other embodiments, the drive gear 15 may be structurally integral with the drive shaft 10. The drive shaft 10 may protrude from a front face of the drive gear 15 along a central axis of the drive gear 15, and may also protrude from a back face of the drive gear 15 along the central axis of the drive gear 15. Embodiments of the drive gear 15 may include teeth along an outer, circumferential surface of the drive gear 15. The gear teeth of drive gear 15 may have various spacing, thickness, pitch, size, and the like. Similarly, a size of the drive gear 15 may vary to accomplish different desired speeds, ratios, torque transmission, and the like, of the gear system 1. Embodiments of the drive gear 15 may be disposed in the gearbox 5.

Furthermore, embodiments of the drive shaft 10 may be driven by a drive unit 2 or driving source. The drive unit 2 or driving source may drive, rotate, or otherwise transmit torque to the drive shaft 10 by various methods, such as a steam turbine, electric motor, and other methods known to those skilled in the art. When the drive shaft 10 is acted upon by the drive unit 2, the drive gear 15 meshes with or otherwise mechanically engages a plurality of pinions, such as the first pinion gear 25, the second pinion gear 35, and the third pinion gear 45. Accordingly, the plurality of pinion gears 25, 35, 45 are rotated in response to the rotation of the drive shaft 10 and drive gear 15, which is rotated by the drive unit 2.

Embodiments of a first pinion 20 may be disposed or otherwise arranged in the gearbox with the drive gear 15. In some embodiments, the first pinion 20 may be disposed to a side of the drive gear 15, along a same horizontal plane or axis as the drive gear 15. The first pinion gear 25 may be operably mounted to the first pinion shaft 20. For instance, the first pinion gear 25 may be fastened to the first pinion shaft 20, wherein rotation of the first pinion gear 25 translates to rotation of the first pinion shaft 20. In other embodiments, the first pinion gear 25 may be structurally integral with the first pinion shaft 20. The first pinion shaft 20 may protrude from a front face of the first pinion gear 25 along a central axis of the first pinion gear 25, and may also protrude from a back face of the first pinion gear 25. Embodiments of the first pinion gear 25 may include teeth along an outer, circumferential surface of the first pinion gear 25. The gear teeth of the first pinion gear 25 may have various spacing, thickness, pitch, size, and the like. Similarly, a size of the first pinion gear 25 may vary to accomplish different desired speeds, ratios, torque transmission, and the like, of the gear system 1.

Furthermore, a compressor stage 70 may be operably connected to each end of the first pinion shaft 20. Embodiments of a compressor stage 70 may be a centrifugal compressor. In some embodiments, a centrifugal compressor may be mounted, directly or otherwise, to each end of the first pinion shaft 20. For example, an impeller of a centrifugal compressor may be directly mounted to a first end 21 of the first pinion shaft 20, wherein a gas is drawn in to be compressed by the compressor 100. In an exemplary embodiment, a centrifugal compressor disposed at the first end 21 of the first pinion shaft 20 may be a first stage of compression. Likewise, an impeller of a centrifugal compressor may be directly mounted or otherwise disposed at the second end 22 of the first pinion shaft 20. In an exemplary embodiment, a centrifugal compressor disposed at the second end 22 of the first pinion shaft 20 may be a second stage of compression. However, in further embodiments, the compression stages 70 disposed at the first end 21 and the second end 22 of the first pinion shaft 20 may comprise two sections of first stage compression.

The compression stages 70 disposed at the ends 21, 22 of the first pinion shaft 20 may be in communication via a pipe or conduit. For instance, gas may be discharged from compression stage 70 disposed at the first end 21 of the first pinion shaft 20 from a discharge pipe to a suction pipe associated with a compressor stage 70 disposed at the second end 22 of the first pinion shaft 20. A heat exchanger, such as an intercooler, may be disposed between the discharge pipe and the suction pipe, as known to those skilled in the art.

With continued reference to FIG. 1, embodiments of a second pinion gear 35 may be disposed or otherwise arranged in the housing with the drive gear 15. In some embodiments, the second pinion gear 35 may be disposed to a side of the drive gear 15, along a same horizontal plane or axis as the drive gear 15. In an exemplary embodiment, the second pinion gear 35 may be located a side opposite the first pinion gear 25. The second pinion gear 35 may be operably mounted to the second pinion shaft 30. For instance, the second pinion gear 35 may be fastened to the second pinion shaft 30, wherein rotation of the second pinion gear 35 translates to rotation of the second pinion shaft 30. In other embodiments, the second pinion gear 35 may be structurally integral with the second pinion shaft 30. The second pinion shaft 30 may protrude from a front face of the second pinion gear 35 along a central axis of the second pinion gear 35, and may also protrude from a back face of the second pinion gear 35 along the central axis of the second pinion gear 35. Embodiments of the second pinion gear 35 may include teeth along an outer, circumferential surface of the second pinion gear 35. The gear teeth of the second pinion gear 35 may have various spacing, thickness, pitch, size, and the like. Similarly, a size of the second pinion gear 35 may vary to accomplish different desired speeds, ratios, torque transmission, and the like, of the gear system 1.

Furthermore, a compressor stage 70 may be operably connected to each end of the second pinion shaft 30. Embodiments of a compressor stage 70 may be a centrifugal compressor. In some embodiments, a centrifugal compressor may be mounted, directly or otherwise, to each end of the second pinion shaft 30. For example, an impeller of a centrifugal compressor may be directly mounted to a first end 31 of the second pinion shaft 30, wherein a gas is drawn in from an earlier stage of compression to be compressed by the compressor 100. In an exemplary embodiment, a centrifugal compressor disposed at the first end 31 of the second pinion shaft 30 may be a third stage of compression. Likewise, an impeller of a centrifugal compressor may be directly mounted or otherwise disposed at the second end 32 of the second pinion shaft 30. In an exemplary embodiment, a centrifugal compressor disposed at the second end 32 of the second pinion shaft 30 may be a fourth stage of compression.

The compression stages 70 disposed at the ends 31, 32 of the second pinion shaft 30 may be in communication via a pipe or conduit. For instance, gas may be discharged from compression stage 70 disposed at the second end 22 of the first pinion shaft 20 from a discharge pipe to a suction pipe associated with a compressor stage 70 disposed at the first end 31 of the second pinion shaft 30. A heat exchanger, such as an intercooler, may be disposed between the discharge pipe and the suction pipe, as known to those skilled in the art.

Furthermore, embodiments of a third pinion gear 45 may be disposed or otherwise arranged in the housing with the drive gear 15. In some embodiments, the third pinion gear 45 may be disposed along a different horizontal plane or axis than the first and second pinion gears 25, 35. In an exemplary embodiment, the third pinion gear 45 may be located above or below the first and second pinion gears 25, 35. The third pinion gear 45 may be operably mounted to the third pinion shaft 40. For instance, the third pinion gear 45 may be fastened to the third pinion shaft 40, wherein rotation of the third pinion gear 45 translates to rotation of the third pinion shaft 40. In other embodiments, the third pinion gear 45 may be structurally integral with the third pinion shaft 40. The third pinion shaft 40 may protrude from a front face of the third pinion gear 45 along a central axis of the third pinion gear 45, and may also protrude from a back face of the third pinion gear 45. Embodiments of the third pinion gear 45 may include teeth along an outer, circumferential surface of the third pinion gear 45. The gear teeth of the third pinion gear 45 may have various spacing, thickness, pitch, size, and the like. Similarly, a size of the third pinion gear 45 may vary to accomplish different desired speeds, ratios, torque transmission, and the like, of the gear system 1.

Furthermore, a compressor stage 70 may be operably connected to each end of the third pinion shaft 40. Embodiments of a compressor stage 70 may be a centrifugal compressor. In some embodiments, a centrifugal compressor may be mounted, directly or otherwise, to each end of the third pinion shaft 40. For example, an impeller of a centrifugal compressor may be directly mounted to a first end 41 of the third pinion shaft 40, wherein a gas is drawn in from an earlier stage of compression to be compressed by the compressor 100. In an exemplary embodiment, a centrifugal compressor disposed at the first end 41 of the third pinion shaft 40 may be a fifth stage of compression. Likewise, an impeller of a centrifugal compressor may be directly mounted or otherwise disposed at the second end 42 of the third pinion shaft 40. In an exemplary embodiment, a centrifugal compressor disposed at the second end 42 of the third pinion shaft 40 may be a sixth stage of compression. The compression stages 70 disposed at the ends 41, 42 of the third pinion shaft 40 may be in communication via a pipe or conduit. For instance, gas may be discharged from compression stage 70 disposed at the second end 32 of the second pinion shaft 30 from a discharge pipe to a suction pipe associated with a compressor stage 70 disposed at the first end 41 of the third pinion shaft 40. A heat exchanger, such as an intercooler, may be disposed between the discharge pipe and the suction pipe, as known to those skilled in the art. The compressed gas discharged by the final compressor stage 70 may be delivered appropriately.

While the above compression stages are described in order, each stage of compression may be disposed at any pinion end of the gear system 1 of the compressor 100. Embodiments of the compressor 100 may include less than six stages of compression, or more than six stages of compression, and may include less than three or more than three pinions and pinion shafts. These variations may be dependent on system requirements.

Further, each of the compression stages 70 disposed at the ends of the pinion shafts may not all be centrifugal compression stages. Embodiments of compressor 100 may include one or more compression stages 70 that are centrifugal compression stages, while one or more compression stages 70 may be positive displacement compression stages. For instance, one or more positive displacement compression stages may be utilized as a compression stage 70 where a centrifugal compression stage is not used. In other words, one or more centrifugal compression stages may be replaced with a positive displacement compression stage. An exemplary embodiment of a positive displacement compression stage is a rotary screw compression stage. The rotary screw compression stage may be embodied as a rotary screw module that can be directly mounted to an end of one of the pinion shafts 20, 30, 40. Embodiments of the rotary screw module may be one or more rotary screw stages, possibly supplied with a secondary gear set to allow for a speed adjustment. In alternative embodiments, the rotary screw module may be attached using a coupling or other intermediate method.

Figure 2:
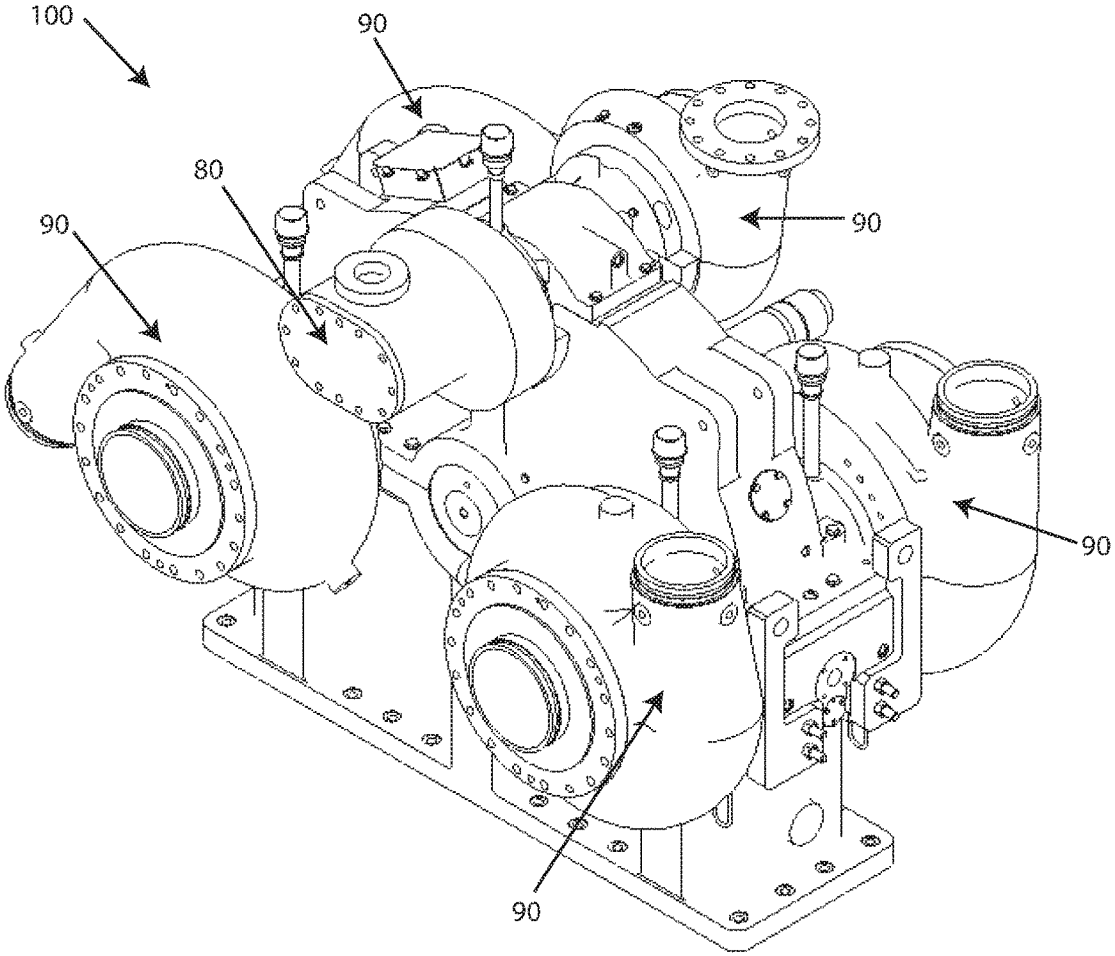
FIG. 2 depicts an embodiment of the compressor shown in FIG. 1, having a positive displacement compression stage and a plurality of centrifugal compression stages.
Figure 3:
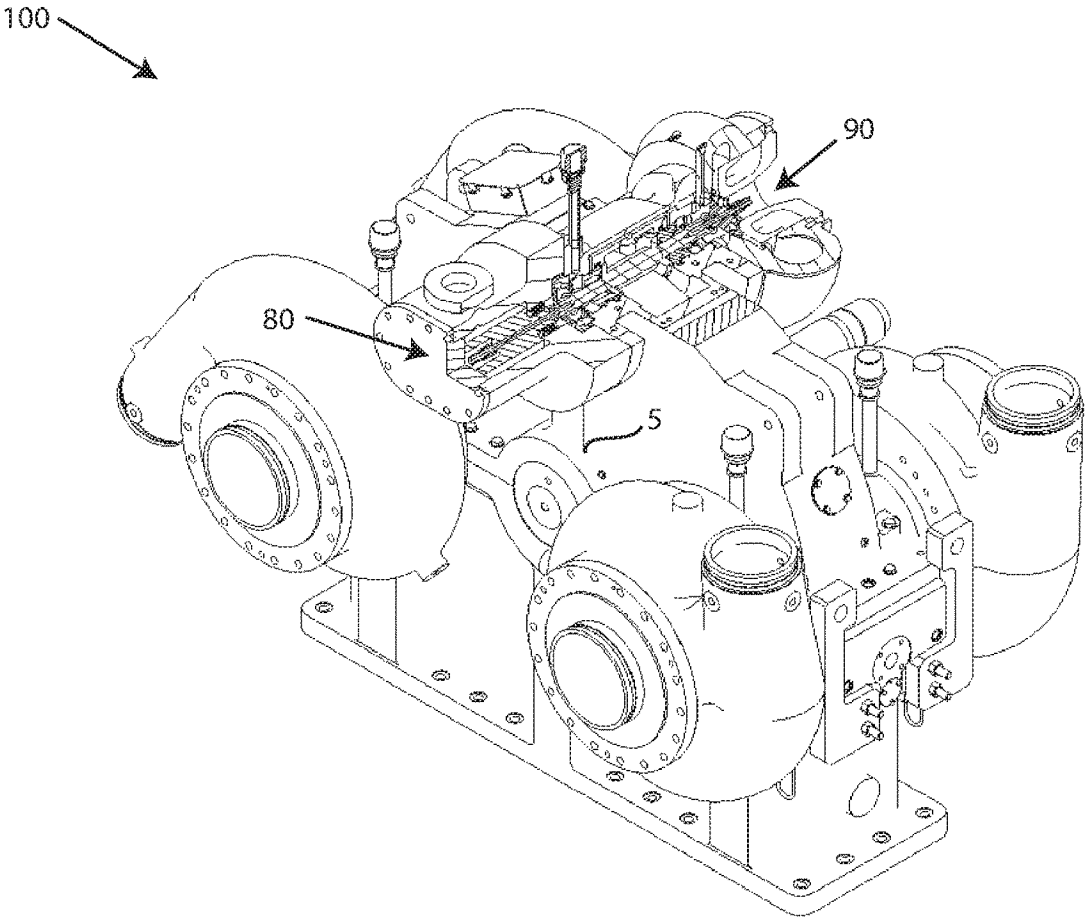
FIG. 3 depicts a partial cut-away view of the compressor shown in FIG. 2.
Figure 4:
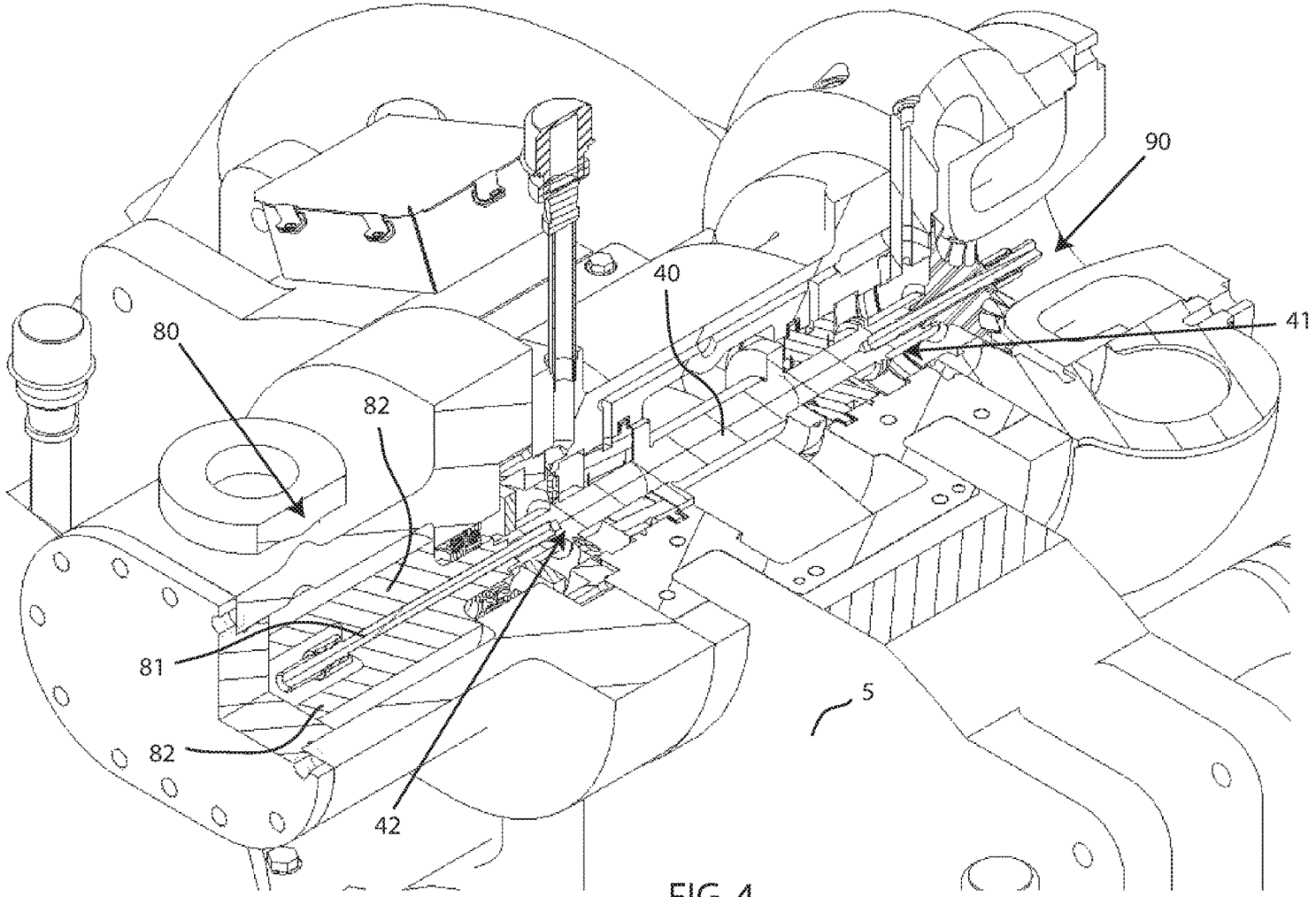
FIG. 4 depicts a detailed view of the partial cut-away view of FIG. 3.
Figure 7:
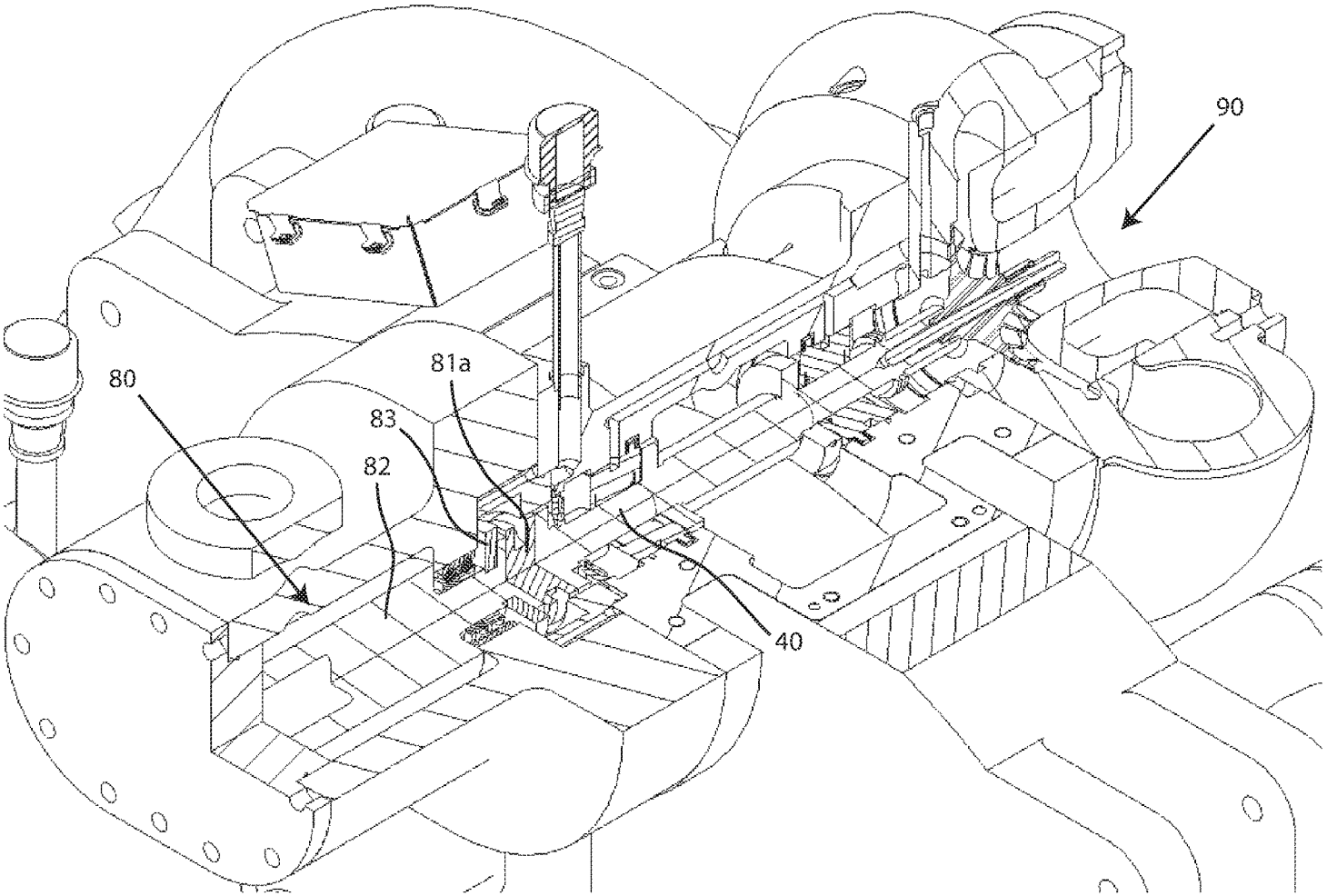
FIG. 7 depicts a detailed view of a partial cut-away view of an alternative embodiment of the compressor shown in FIG. 2.
Figure 8:
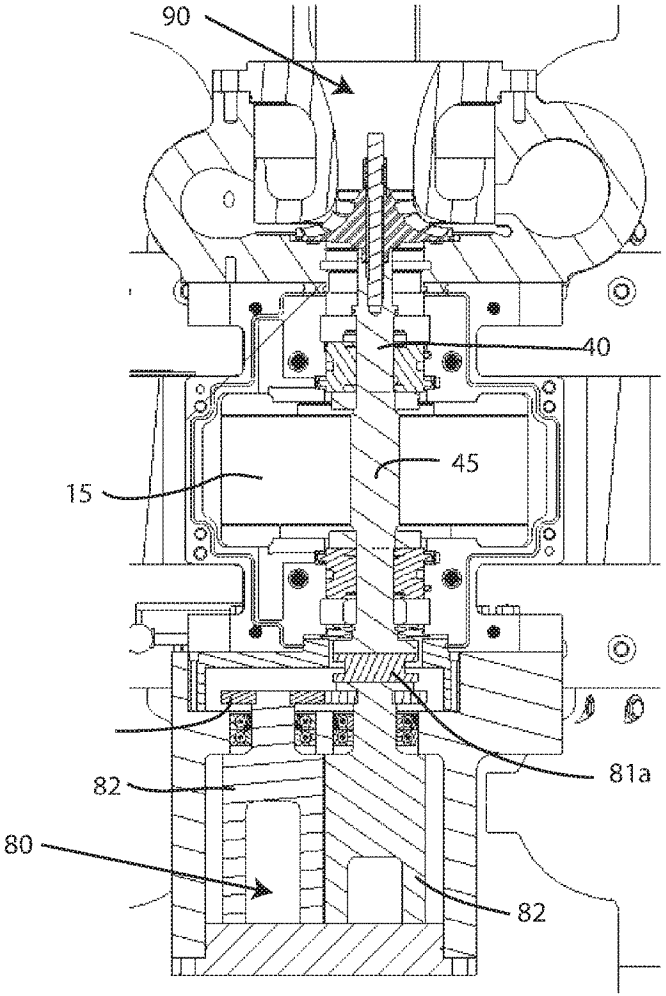
FIG. 8 depicts of a top view of a cross-section of the alternative embodiment of the compressor shown in FIG. 7.
Figure 9:
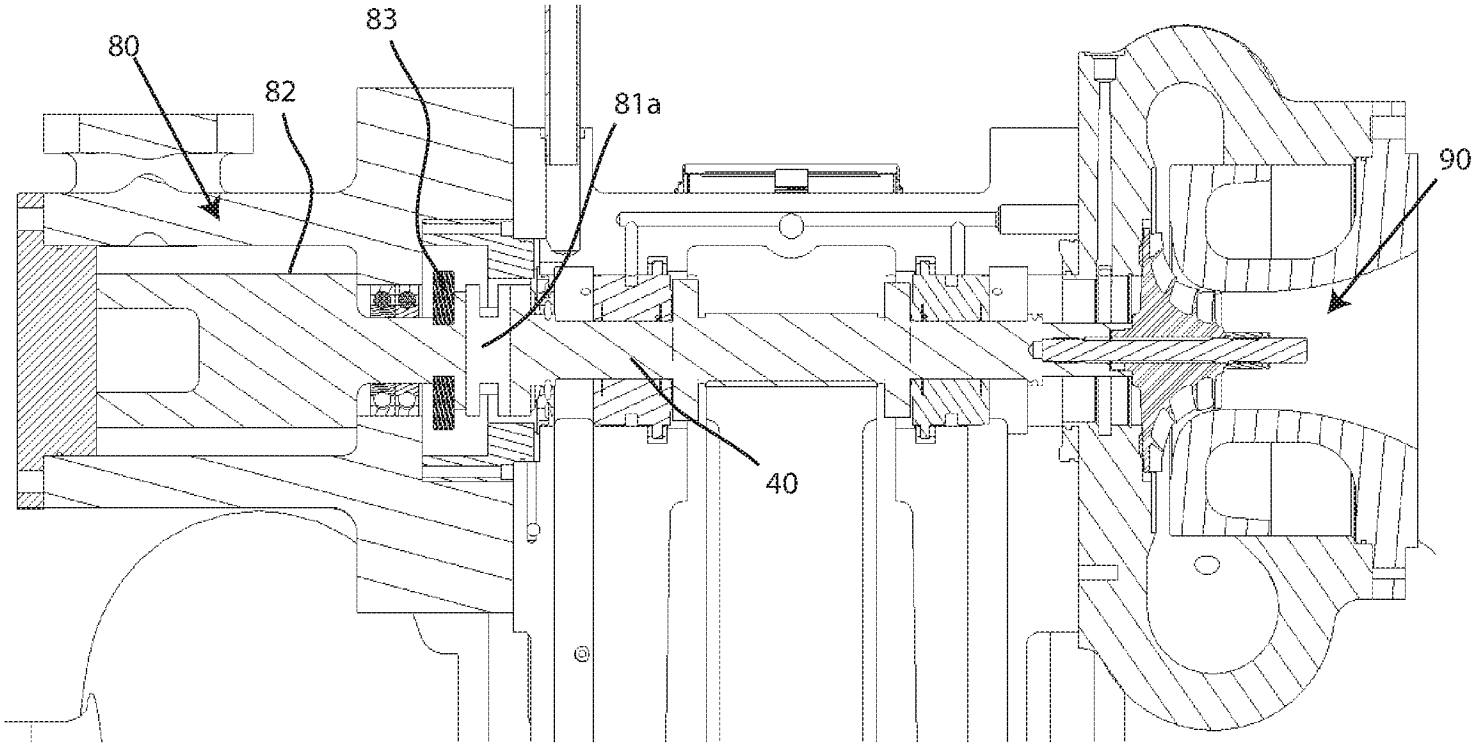
FIG. 9 depicts a side view of a cross-section of the alternative embodiment of the compressor shown in FIG. 7.

FIG. 2 depicts an embodiment of compressor 100 shown in FIG. 1, having a positive displacement compression stage 80 and a plurality of centrifugal compression stages 90. FIGS. 3-6 depict the positive displacement compression stage 80 attached or otherwise coupled (e.g. directly coupled) to the second end 42 of the third pinion 40, while an impeller of a centrifugal compression stage 90 is attached to the first end 41 of the third pinion 40. The positive displacement compression stage 80 may include one or more screws 82, a connection method 81, and screw gearing 83 (e.g. a secondary gear set to allow for speed adjustment). FIGS. 7-9 depicts an alternative embodiment of compressor 100, which includes connection method 81*a*.

Figure 5:
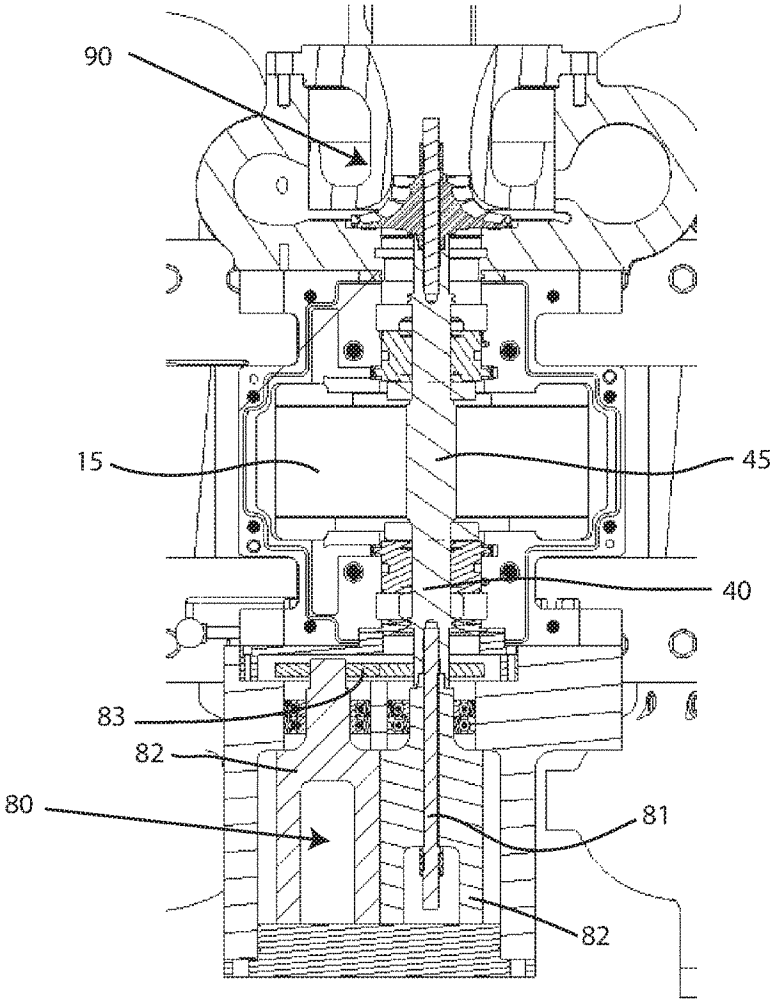
FIG. 5 depicts of a top view of a cross-section of the compressor shown in FIG. 2.
Figure 6:
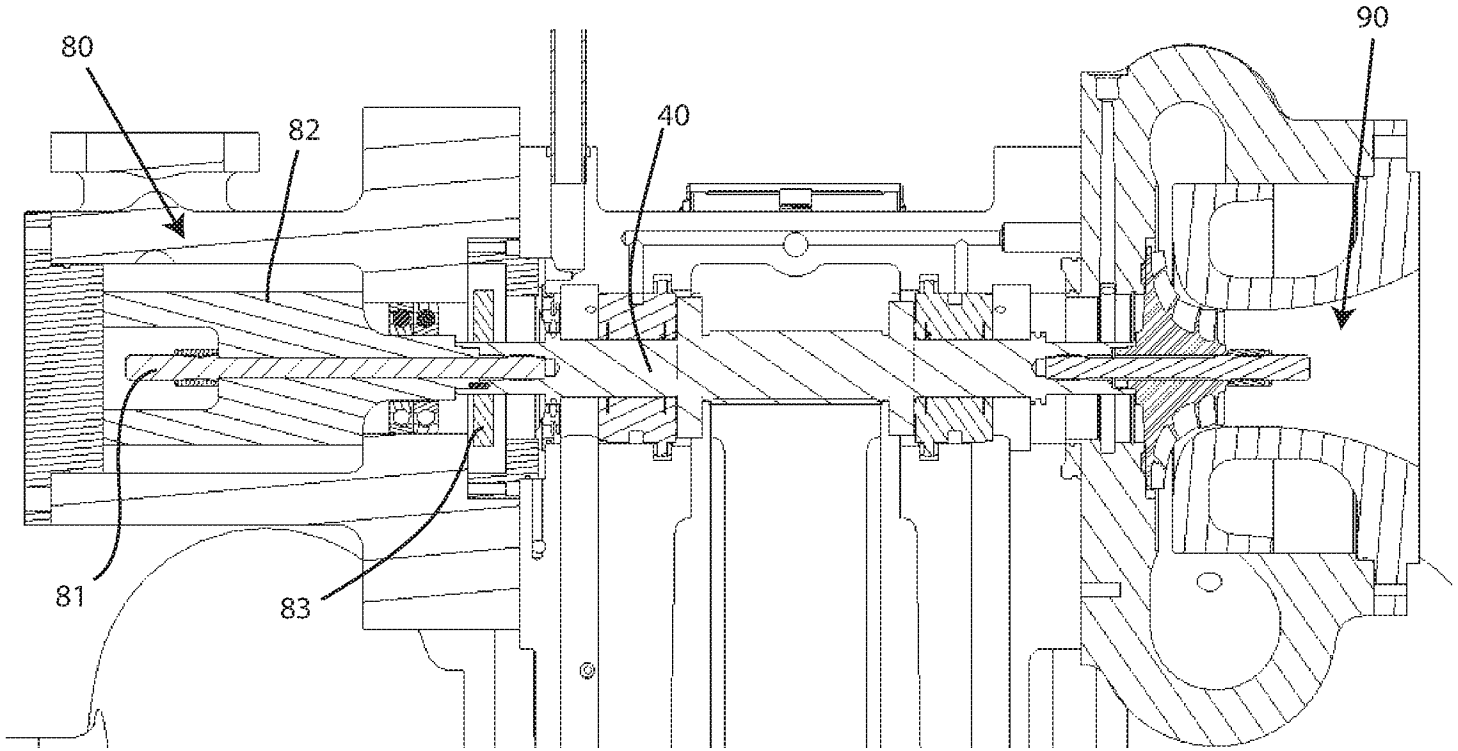
FIG. 6 depicts a side view of a cross-section of the compressor shown in FIG. 2.

As shown in FIGS. 5 and 8, as the drive gear 15 is rotated by drive unit 2, the third pinion gear 45 is rotated, which in turn rotates the third pinion shaft 40 that simultaneously actuates (e.g. rotates) the compression screws 82 of the positive displacement compression stage 80 and the impeller of the centrifugal compression stage 90. In an exemplary embodiment, the positive displacement compression stage 80 is a fifth or sixth stage of compression. The positive displacement compression stage 80 may also be an earlier stage of compression, or may be located at earlier stages of compression and later stages of compression.

Embodiments of compressor 100 may be used for a number of different applications and under various conditions. Exemplary applications include LNG handling and management and LNG powered vessels. For LNG applications, a supply side of the compressor 100 (e.g. feed gas or supply gas being initially drawn into compressor 100) is typically cryogenic and low pressure. Conversely, as the gas is further compressed, the gas becomes high pressure, smaller volumes, and non-cryogenic. Thus, embodiments of the compressor 100 may include compression stages 70 that are represented by centrifugal compression stages near the beginning of the compression process, while compression stages 70 may be represented by a positive displacement compression stage near the delivery side of the compressor 100. However, it is contemplated that the compression stages 70 of compressor 100 may be any combination of centrifugal compression stages and positive displacement stages.

Figure 10:
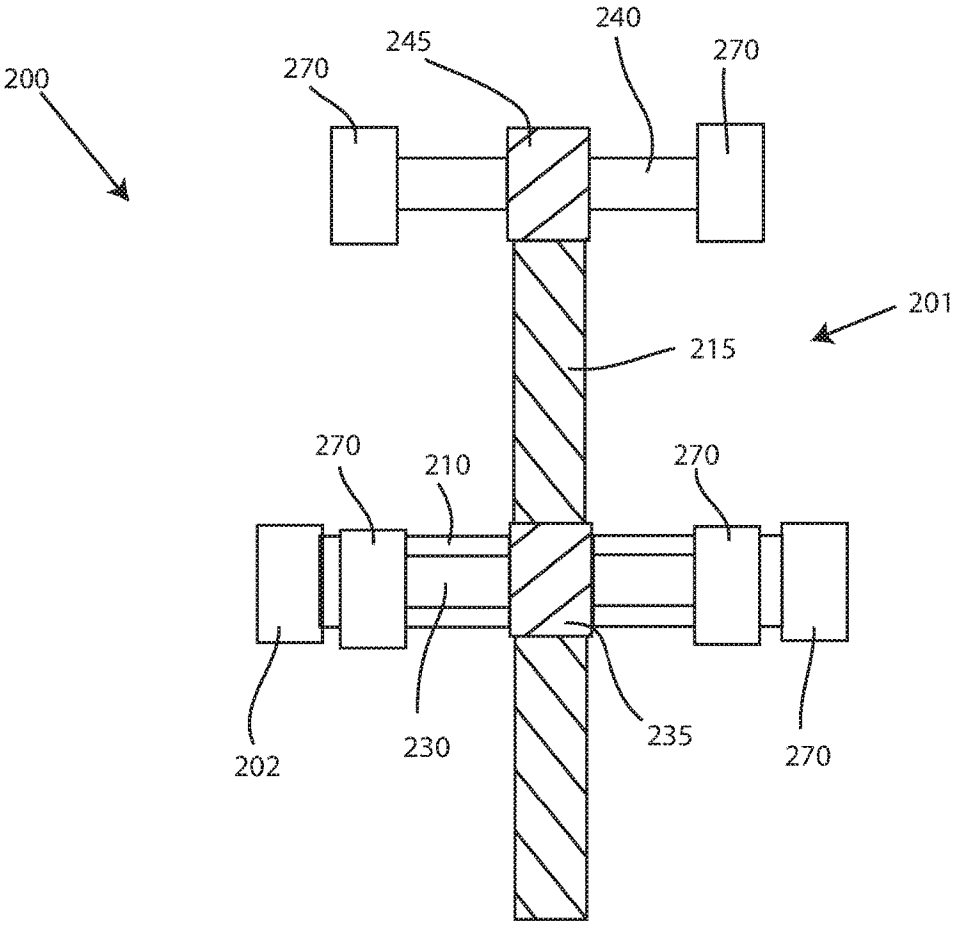
FIG. 10 depicts a side view of a schematic illustration of a second embodiment of a compressor.

Referring now to FIG. 10, an embodiment of compressor 200 is depicted. Embodiments of compressor 200 may share the same, substantially the same, similar, or substantially similar structure and function as compressor 100. For instance, embodiments of compressor 200 may include a gear system 201, including a plurality of pinions, such as first pinion, second pinion gear 235, and third pinion gear 245, a plurality of pinion shafts, such as first pinion shaft (not shown), second pinion shaft 230, and third pinion shaft 240, a drive gear 215, and a drive shaft 210. Further, embodiments of compressor 200 may include a plurality of compression stages 270 operably attached to gear system 201, wherein the gear system 201 may be arranged in a single gearbox. However, embodiments of compressor 200 may include a positive displacement compression stage attached to an end of the drive shaft 210 that is opposite the end to which the drive unit 202 is operably attached. For instance, a rotary screw module may be directly mounted to the drive shaft 210, or may be attached using a coupling or other intermediate method. The remaining compression stages 270 may be centrifugal compression stages. In further embodiments, a positive displacement compression stage may be operably attached to the gear system 201 of compressor 200 at additional locations, wherein the remaining compression stages 270 are not all centrifugal compression stages.

Figure 11:
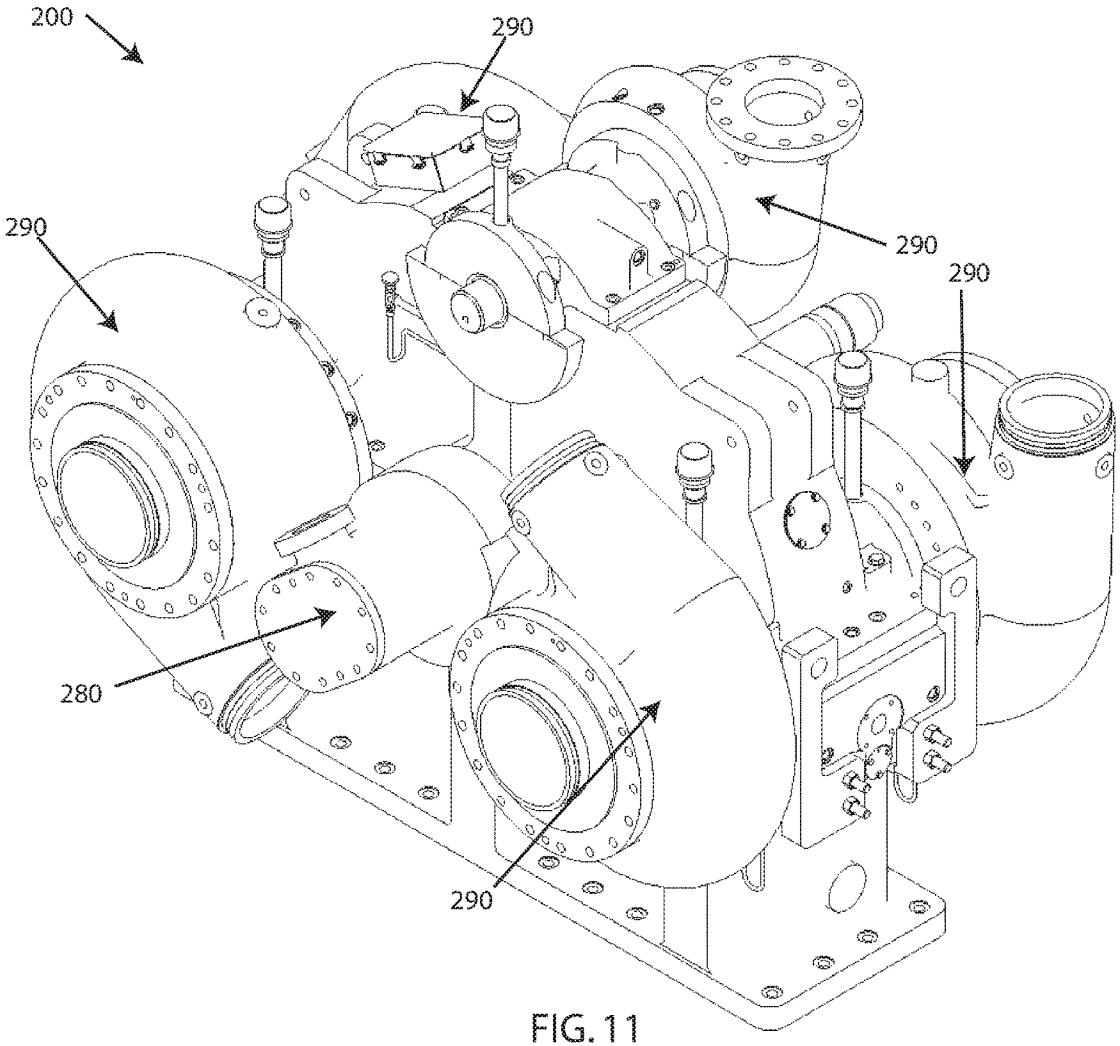
FIG. 11 depicts an embodiment of the compressor shown in FIG. 10, having a positive displacement compression stage and a plurality of centrifugal compression stages.
Figure 12:
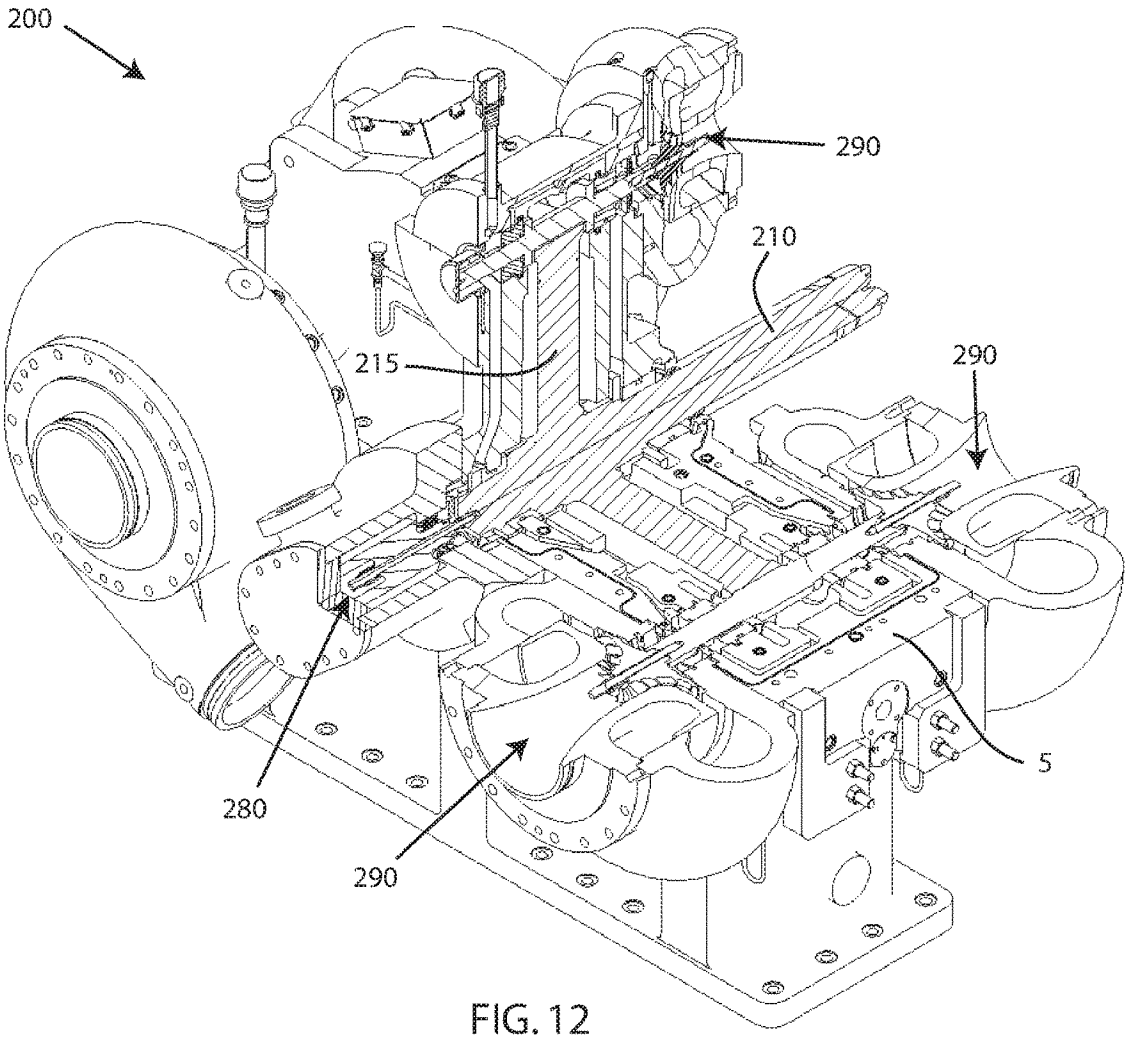
FIG. 12 depicts a partial cut-away view of the compressor shown in FIG. 11.
Figure 13:
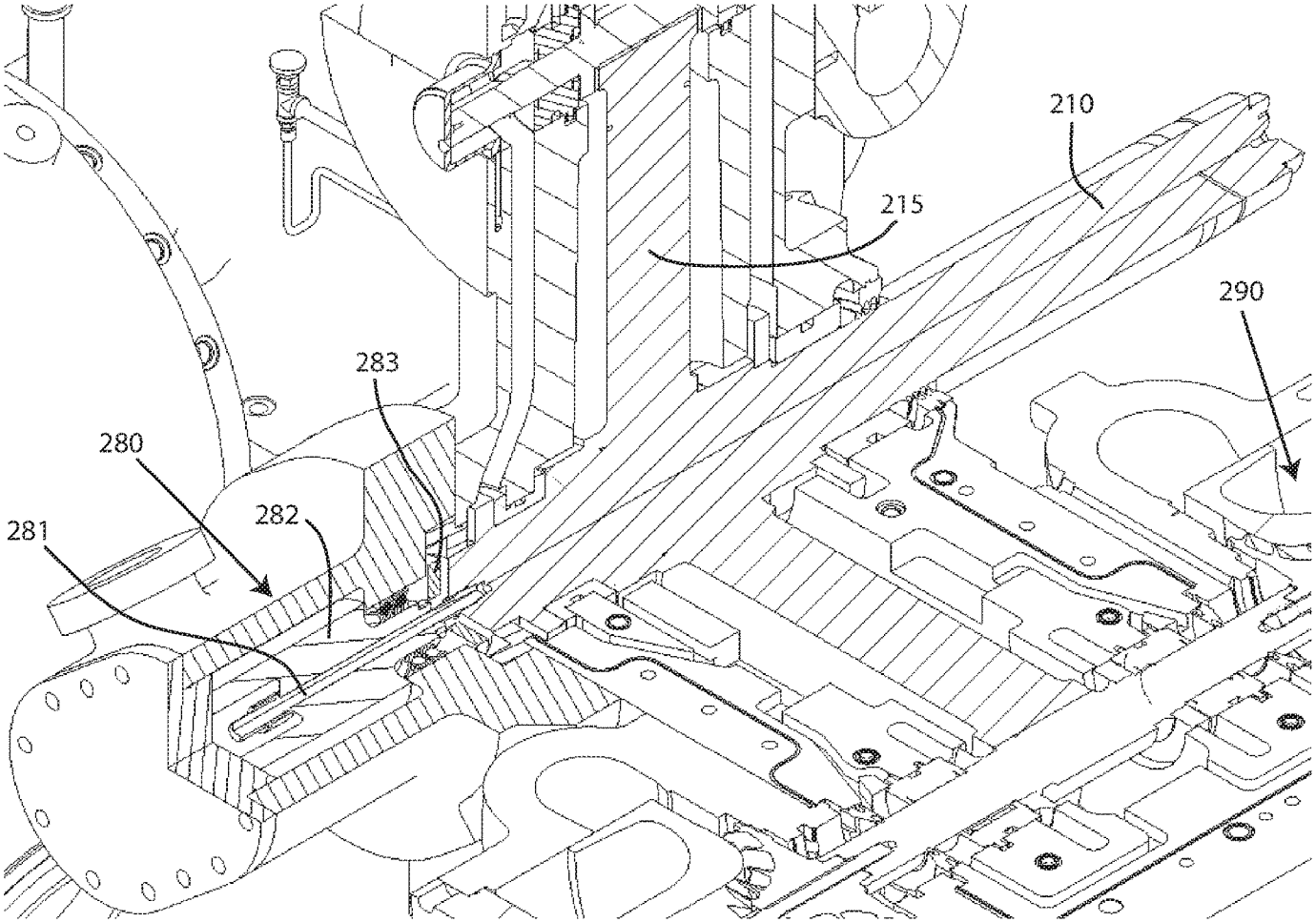
FIG. 13 depicts a detailed view of the partial cut-away view of FIG. 12.
Figure 14:
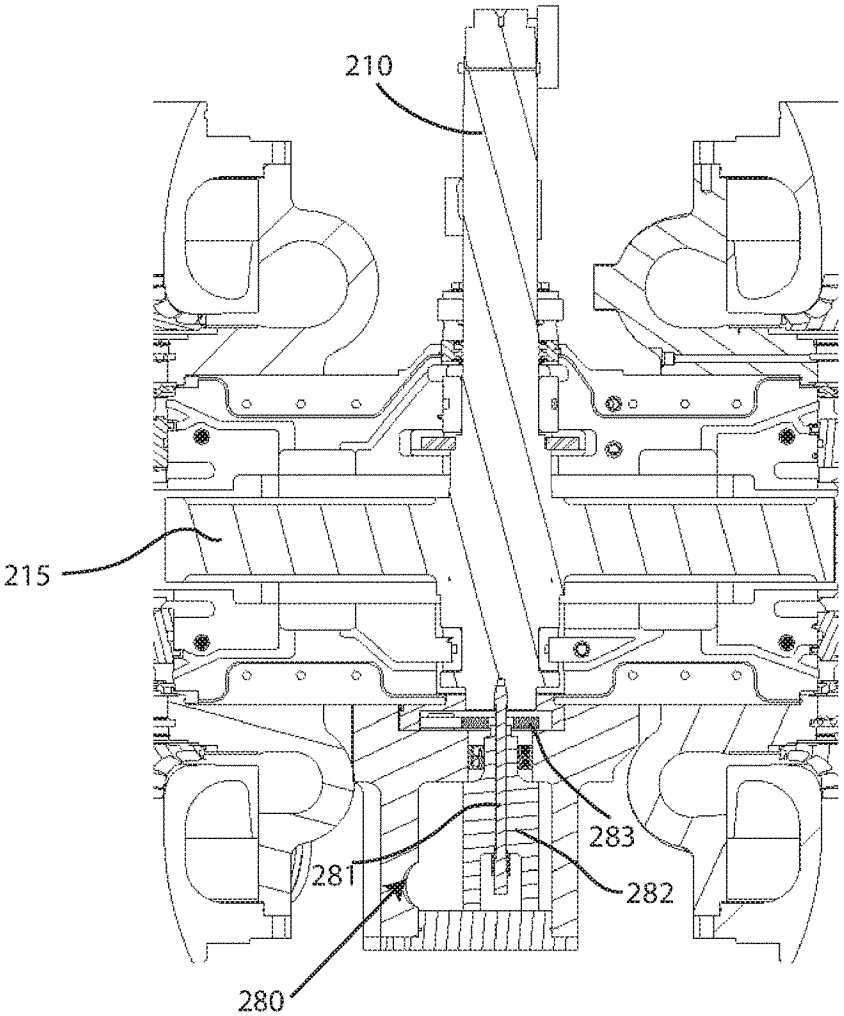
FIG. 14 depicts of a top view of a cross-section of the compressor shown in FIG. 10.
Figure 15:
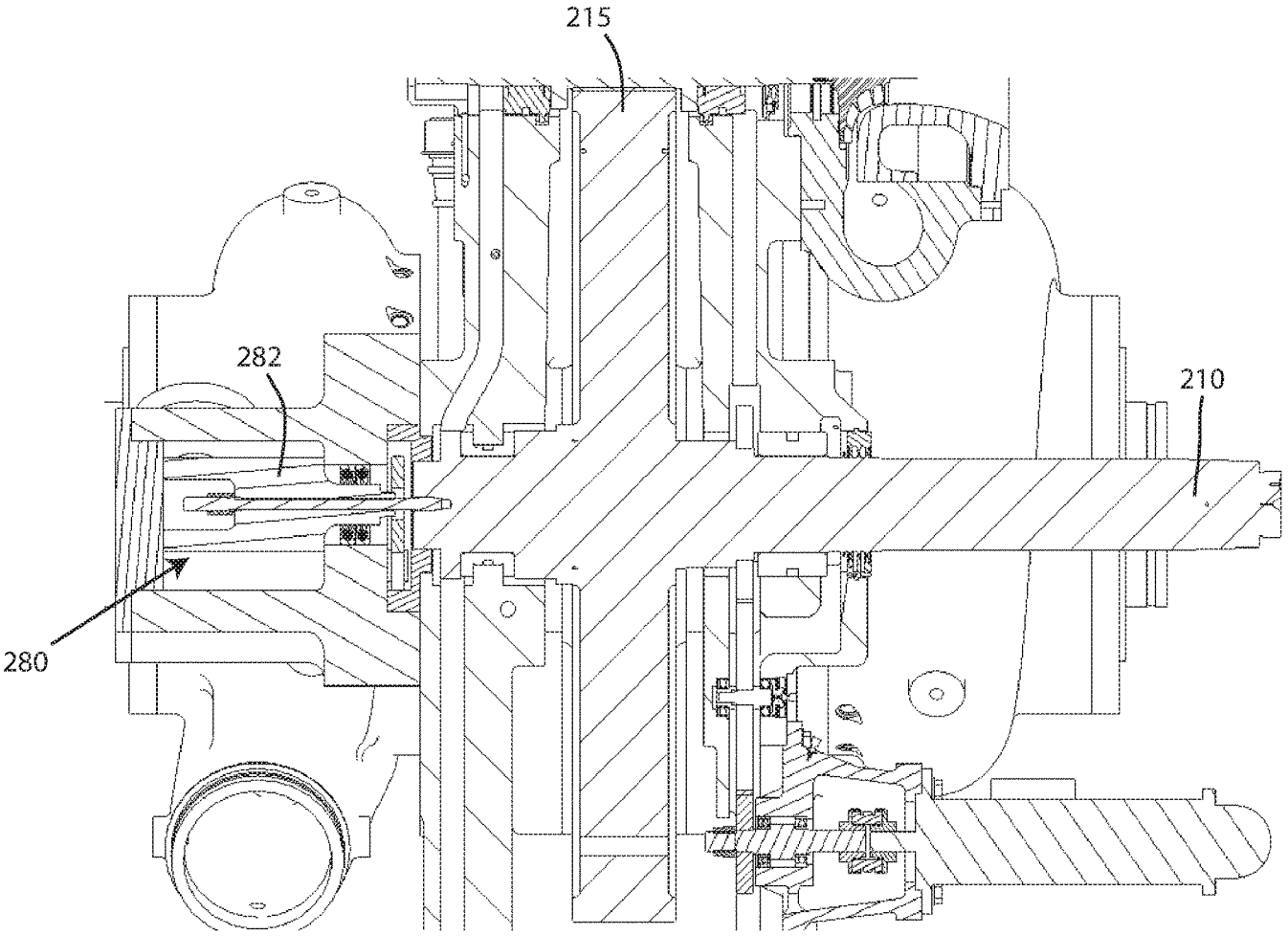
FIG. 15 depicts a side view of a cross-section of the compressor shown in FIG. 10.

FIG. 11 depicts an embodiment of compressor 200 shown in FIG. 10, having a positive displacement compression stage 280 and a plurality of centrifugal compression stages 290. FIGS. 12-15 depict the positive displacement compression stage 280 attached or otherwise coupled (e.g. directly coupled) to the drive shaft 210. The positive displacement compression stage 280 may include one or more screws 282, a connection method 281, and screw gearing 283 (e.g. a secondary gear set to allow for speed adjustment). As shown in FIG. 14, as the drive gear 215 is rotated by the drive unit, the drive shaft 210 is rotated, which in turn simultaneously actuates (e.g. rotates) the compression screws 282 of the positive displacement compression stage 280, and the impellers of the centrifugal compression stages 290. In an exemplary embodiment, the positive displacement compression stage 280 may be a fifth or sixth stage of compression. The positive displacement compression stage 280 may also be an earlier stage of compression, or may be located at earlier stages of compression and later stages of compression.

Figure 16:
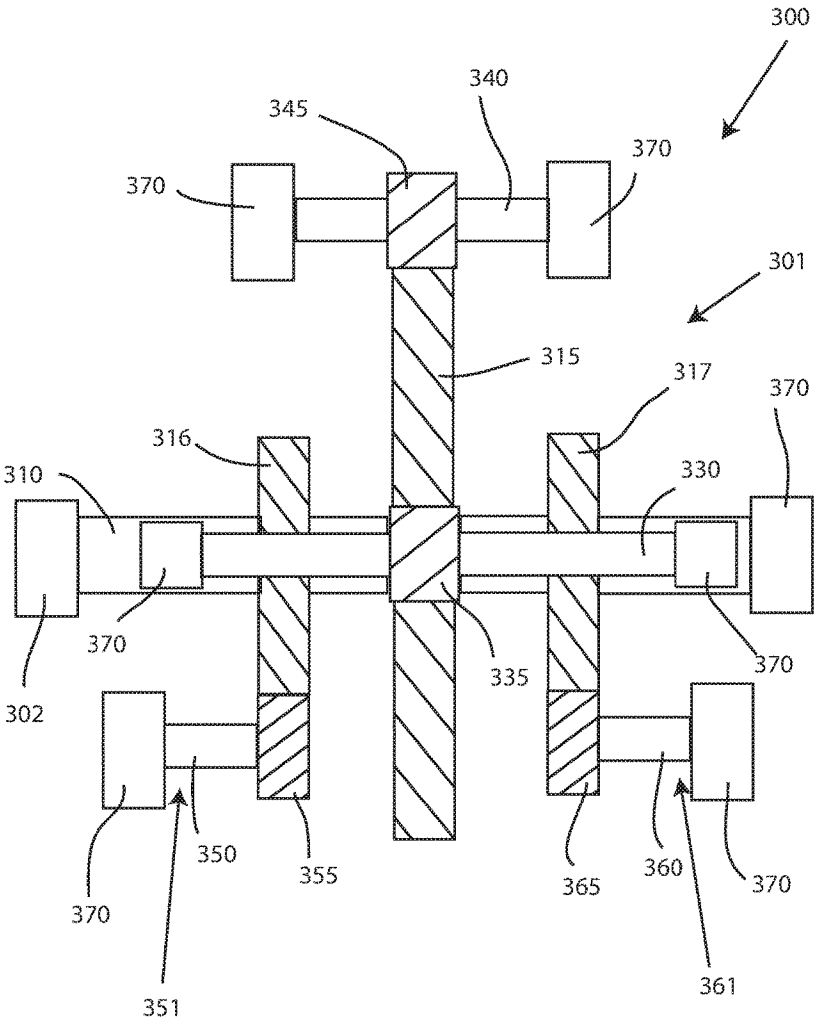
FIG. 16 depicts a side view of schematic illustration of a third embodiment of a compressor.

With continued reference to the drawings, FIG. 16 depicts an embodiment of compressor 300. Embodiments of compressor 300 may share the same, substantially the same, similar, or substantially similar structure and function as compressor 100, 200. For instance, embodiments of compressor 300 may include a gear system 301, including a plurality of pinions, such as first pinion, second pinion gear 335, and third pinion gear 345, a plurality of pinion shafts, such as first pinion shaft and second pinion shaft 330, a drive gear 315, and a drive shaft 310. Further, embodiments of compressor 300 may include a plurality of compression stages 370 operably attached to gear system 301, wherein the gear system 301 may be arranged in a single housing or gearbox. However, embodiments of compressor 300 may further include additional drive gears operably connected to the drive shaft 310. For instance, embodiments of compressor may include a first secondary gear 316 and a second secondary gear 317.

The first secondary gear 316 may be disposed on the drive shaft 310, and may mesh or otherwise engage with a fourth pinion 355, which is operably attached to a fourth pinion shaft 350. In some embodiments, the fourth pinion gear 355 may be disposed along a different horizontal plane or axis than the drive gear 315. For example, the fourth pinion gear 355 may be disposed a distance from the drive gear 315 in a direct toward the drive unit 302. The fourth pinion gear 355 may be operably mounted to the fourth pinion shaft 350. For instance, the fourth pinion gear 355 may be fastened to the fourth pinion shaft 350, wherein rotation of the fourth pinion gear 355 translates to rotation of the fourth pinion shaft 350. In other embodiments, the fourth pinion gear 355 may be structurally integral with the fourth pinion shaft 350. The fourth pinion shaft 350 may protrude from a front face of the fourth pinion 355 along a central axis of the fourth pinion gear 355. Embodiments of the fourth pinion gear 345 may include teeth along an outer, circumferential surface of the fourth pinion gear 355. The gear teeth of the fourth pinion gear 355 may have various spacing, thickness, pitch, size, and the like. Similarly, a size of the fourth pinion gear 355 may vary to accomplish different desired speeds, ratios, torque transmission, and the like, of the gear system 301.

Furthermore, a compressor stage 370 may be operably connected to an end 351 of the fourth pinion shaft 350. Embodiments of a compressor stage 370 may be a positive displacement compressor stage. In some embodiments, a positive displacement compressor may be mounted, directly or otherwise, to an end 351 of the fourth pinion shaft 350.

The second secondary gear 317 may be disposed on the driver shaft 310, and may mesh or otherwise engage with a fifth pinion gear 365, which is operably attached to a fifth pinion shaft 360. In some embodiments, the fifth pinion gear 365 may be disposed along a different horizontal plane or axis than the drive gear 315. For example, the fifth pinion gear 365 may be disposed a distance from the drive gear 315 in a direction away from the drive unit 302. The fifth pinion gear 365 may be operably mounted to the fifth pinion shaft 360. For instance, the fifth pinion gear 365 may be fastened to the fifth pinion shaft 360, wherein rotation of the fifth pinion gear 365 translates to rotation of the fifth pinion shaft 360. In other embodiments, the fifth pinion gear 365 may be structurally integral with the fifth pinion shaft 360. The fifth pinion shaft 360 may protrude from a face of the fifth pinion gear 365 along a central axis of the fifth pinion gear 365. Embodiments of the fifth pinion gear 365 may include teeth along an outer, circumferential surface of the fifth pinion gear 365. The gear teeth of the fifth pinion gear 365 may have various spacing, thickness, pitch, size, and the like. Similarly, a size of the fifth pinion gear 365 may vary to accomplish different desired speeds, ratios, torque transmission, and the like, of the gear system 301.

Moreover, a compressor stage 370 may be operably connected to an end 361 of the fifth pinion shaft 360. Embodiments of a compressor stage 370 may be a positive displacement compressor stage. In some embodiments, a positive displacement compressor may be mounted, directly or otherwise, to an end 361 of the fifth pinion shaft 360.

In some embodiments, compressor 300 may also include a positive displacement compression stage operably attached to an end of the drive shaft 310 opposite the end to which the drive unit 302 is attached. Accordingly, embodiments of the compressor 300 may include at least three positive displacement compression stages, used in combination with one or more centrifugal compression stages at other compression stages 370. In further embodiments, a positive displacement compression stage may be operably attached to the gear system 301 of compressor 300 at additional locations, wherein the remaining compression stages 370 are not all centrifugal compression stages.

Figure 17:
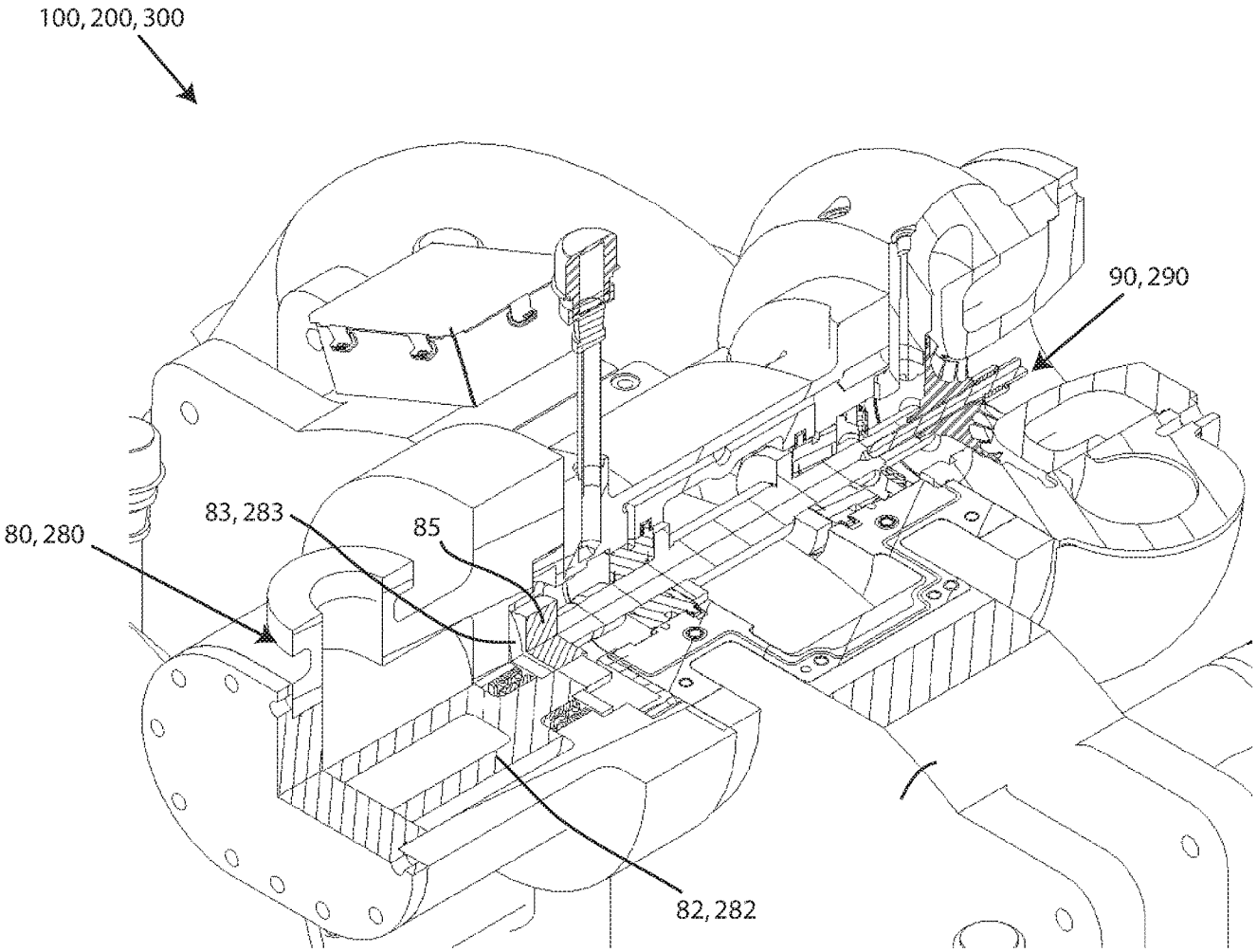
FIG. 17 depicts an embodiment of a compressor having an indirect mount positive displacement compression stage.
Figure 18:
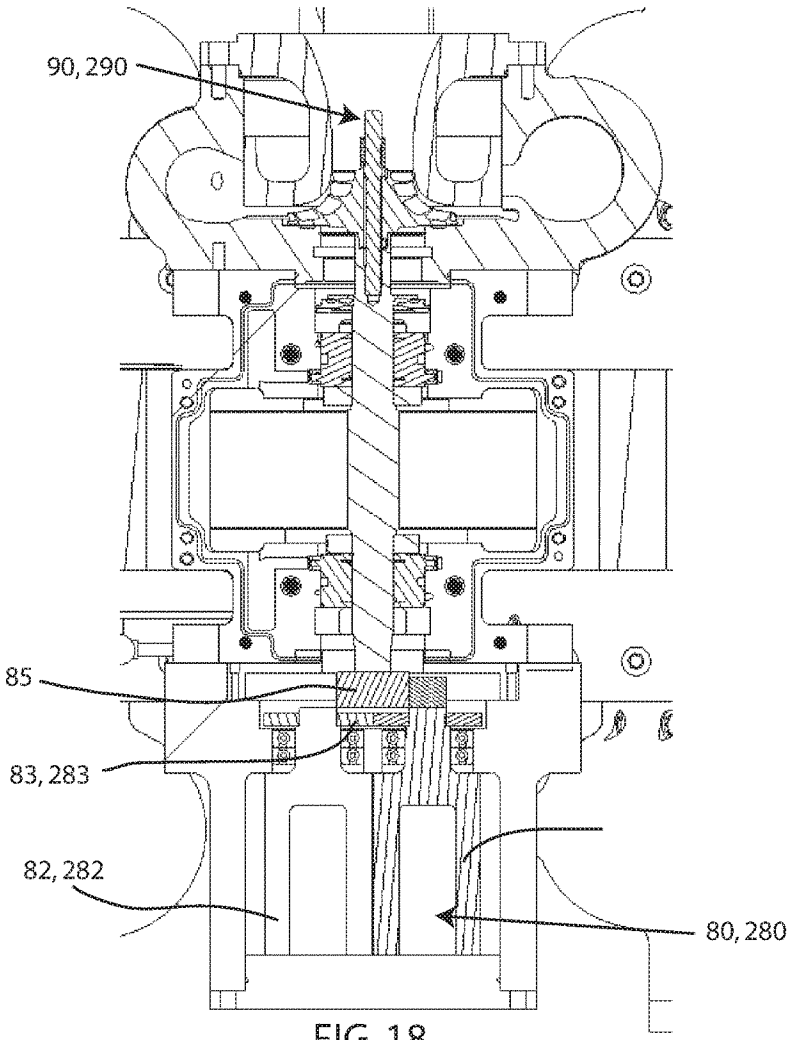
FIG. 18 depicts a top view of an embodiment of the compressor shown in FIG. 17

FIGS. 17-18 depict an embodiment of a compressor 100, 200, 300 having an indirect mount positive displacement compression stage 80, 280. Embodiments of a positive displacement compressor 80, 280 may be mounted to the gear system 101, 201, 301 via pinion gearing 85, in addition to the screw gearing 83, 283.

Referring to FIGS. 1-18, a method of utilizing a combination of centrifugal compression stages and positive displacement compression stages may include the following steps of providing compressor 100, 200, 300 including a gear system 1, 201, 301 configured to be driven by a drive unit 2, 202, 302, a plurality of compression stages 70, 270, 370 coupled to the gear system 1, 201, 301, wherein the plurality of compression stages 70, 270, 370 includes at least one centrifugal compression stage and at least one positive displacement compression stage.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes zmay be made without departing from the spirit and scope of the invention, as required by the following claims. The claims provide the scope of the coverage of the invention and should not be limited to the specific examples provided herein.

What is claimed is:

1. A compressor comprising:

a gear system configured to be driven by a drive unit;

a plurality of compression stages coupled to the gear system, wherein a gas discharged from a first compression stage is directed to a second compression stage:

wherein the plurality of compression stages includes at least a centrifugal compression stage attached to a first end of a pinion shaft and at least a positive displacement compression stage attached to a second end of the pinion shaft along with a screw gearing, separate from the gear system, which allows for a speed adjustment of the positive displacement compression stage.

2. The compressor of claim 1, wherein the gear system is arranged in a single gearbox.

3. The compressor of claim 1, wherein the compressor is an integrally geared compressor.

4. The compressor of claim 1, wherein the gear system includes a plurality of pinion shafts, a plurality of pinion gears operably connected to the plurality of pinion shafts, a drive gear, and a drive shaft.

5. The compressor of claim 1, wherein the at least one centrifugal compression stage includes an impeller.

6. The compressor of claim 1, wherein the at least one positive displacement compression stage includes a rotary screw compressor.

7. The integrally geared compressor of claim 1, wherein the positive displacement compression stage is directly mounted.

8. The integrally geared compressor of claim 1, wherein the positive displacement compression stage is indirectly mounted.

9. An integrally geared compressor having a gearbox, comprising:

a drive gear, the drive gear including a drive shaft coupled to a drive unit;

a first pinion gear meshed with the drive gear on a first side of the drive gear, the first pinion gear including a first pinion shaft;

a second pinion gear meshed with the drive gear on a second side of the drive gear, the second pinion gear including a second pinion shaft;

a third pinion gear meshed with the drive gear on a different plane than the first pinion gear and the second pinion gear, the third pinion gear include a third pinion shaft;

a positive displacement compression stage coupled to: (i) the first pinion shaft, or (ii) the drive shaft, wherein the positive displacement compression stage includes a screw gearing separate from the drive gear that allows for a speed adjustment of the positive displacement compression stage; and a centrifugal compression stage coupled to the second pinion shaft.

10. The integrally geared compressor of claim 9, wherein the positive displacement compression stage including at least one screw.

11. The integrally geared compressor of claim 9, wherein the positive displacement compression stage is after a third compression stage of the integrally geared compressor.

12. The integrally geared compressor of claim 9, wherein the positive displacement compression stage is before a fourth compression stage of the integrally geared compressor.

13. The integrally geared compressor of claim 9, further comprising: a first secondary gear disposed on the drive shaft, the first secondary gear meshing with a fourth pinion gear, which is operably attached to a fourth pinion shaft.

14. The integrally geared compressor of claim 9, further comprising: a second secondary gear disposed on the drive shaft, the secondary gear messing with a fifth pinion gear, which is operably attached to a fifth pinion shaft.

15. The integrally geared compressor of claim 9, wherein the positive displacement compression stage is directly mounted.

16. The integrally geared compressor of claim 9, wherein the positive displacement compression stage is indirectly mounted.

17. The integrally geared compressor of claim 9, wherein the positive displacement compression stage is after a third compression stage of the integrally geared compressor.

18. The integrally geared compressor of claim 9, wherein the positive displacement compression stage is before a fourth compression stage of the integrally geared compressor.

19. A method comprising:

combining at least one centrifugal compression stage and at least one positive displacement compression stage in an integrally geared compressor having a gear system configured to be driven by a drive unit, wherein the at least one centrifugal compression stage is attached to a first end of a first pinion shaft and the at least one positive displacement compression stage is attached to a second end of the first pinion shaft along with a screw gearing separate from the gear system that allows for a speed adjustment of the at least one positive displacement compression stage;

wherein a gas discharged from the at least one centrifugal compression stage is directed to the at least one positive displacement compression stage.

20. The method of claim 19, wherein the gear system includes a drive gear, the drive gear including a drive shaft coupled to the drive unit, a first pinion gear meshed with the drive gear on a first side of the drive gear, the first pinion gear including the first pinion shaft, a second pinion gear meshed with the drive gear on a second side of the drive gear, the second pinion gear including a second pinion shaft, and a third pinion gear meshed with the drive gear on a different plane than the first pinion gear and the second pinion gear, the third pinion gear includes a third pinion shaft.

* * * * *